US007219770B2

(12) United States Patent
Baker

(10) Patent No.: US 7,219,770 B2
(45) Date of Patent: May 22, 2007

(54) COORDINATED LIFT SYSTEM WITH USER SELECTABLE RF CHANNELS

(76) Inventor: William J. Baker, 8861 SE. 40th Rd., St. Joseph, MO (US) 64507

( * ) Notice: Subject to any disclaimer, the term of this patent is extended or adjusted under 35 U.S.C. 154(b) by 545 days.

(21) Appl. No.: 10/902,684

(22) Filed: Jul. 29, 2004

(65) Prior Publication Data

US 2005/0045429 A1 Mar. 3, 2005

Related U.S. Application Data

(60) Provisional application No. 60/491,953, filed on Aug. 1, 2003.

(51) Int. Cl.
*B66F 7/16* (2006.01)
*B66F 9/04* (2006.01)

(52) U.S. Cl. ..... 187/247; 187/210; 187/226; 254/45

(58) Field of Classification Search ..... 187/224, 187/226, 227, 233, 247–250, 276, 277, 413, 187/203, 207, 210, 213; 254/11, 12, 45, 254/47, 419, 424, 275, 290, 427, 273; 414/564, 414/610, 628, 630
See application file for complete search history.

(56) References Cited

U.S. PATENT DOCUMENTS 3,757,895 A 9/1973 Knutson
3,958,664 A 5/1976 Perkins
4,131,263 A 12/1978 John
4,141,526 A 2/1979 John
D252,324 S 7/1979 John
4,173,268 A 11/1979 Nussbaum (Continued)

FOREIGN PATENT DOCUMENTS

DE 26 49 769 5/1978

(Continued)

OTHER PUBLICATIONS

The EVJ "Under-The-Hoist" Jack, published by Meyer Hydraulics Corporation, dated 1997.

(Continued)

*Primary Examiner*—Lincoln Donovan
*Assistant Examiner*—Eduardo Colon Santana
(74) *Attorney, Agent, or Firm*—Shughart Thomson & Kilroy PC

(57) ABSTRACT

A coordinated lift system with user selectable RF channels coordinates the raising and lowering of a vehicle relative to a surface by using wireless communications. The lift system includes at least two lift mechanisms each having support frame, including a post, a carriage, an actuating device, and a control device with a channel selector switch. The carriage is slidably mounted on the post and is configured to support a portion of the vehicle. The actuating device is engaged between the support frame and the carriage and is activated to move the carriage relative to the post. The control device is interfaced with the actuating device and includes an RF transceiver to enable communication by RF signals with the other control device. The channel on which the transceiver operates is user selectable in the field. A rechargeable battery may provide power to the control device to allow for increased mobility of the lift system.

15 Claims, 7 Drawing Sheets

U.S. PATENT DOCUMENTS

| | | | | |
|---|---|---|---|---|
| 4,187,927 | A | 2/1980 | Byrne | |
| 4,230,196 | A | 10/1980 | Snead | |
| 4,245,808 | A | 1/1981 | John | |
| 4,252,217 | A * | 2/1981 | Benjamin | 414/592 |
| 4,334,667 | A | 6/1982 | Fox | |
| 4,573,663 | A | 3/1986 | Nussbaum | |
| 4,746,133 | A | 5/1988 | Hanser et al. | |
| 4,777,798 | A | 10/1988 | Jacobson et al. | |
| 5,176,225 | A | 1/1993 | Nussbaum | |
| 5,180,131 | A | 1/1993 | Few | |
| 5,197,311 | A | 3/1993 | Clark | |
| D334,879 | S | 4/1993 | Few | |
| 5,205,586 | A | 4/1993 | Tallman | |
| 5,284,321 | A | 2/1994 | Meyer | |
| 5,299,658 | A | 4/1994 | Cox et al. | |
| D347,955 | S | 6/1994 | Leftwich | |
| 5,330,315 | A * | 7/1994 | Beattie et al. | 414/814 |
| D349,801 | S | 8/1994 | Few et al. | |
| D350,055 | S | 8/1994 | Few | |
| 5,335,755 | A * | 8/1994 | Miller | 414/249 |
| 5,348,330 | A | 9/1994 | Few et al. | |
| 5,410,894 | A | 5/1995 | Fox et al. | |
| 5,435,523 | A | 7/1995 | Hying et al. | |
| 5,444,199 | A | 8/1995 | Burchard et al. | |
| 5,484,134 | A | 1/1996 | Francis | |
| 5,501,428 | A | 3/1996 | Garceau | |
| 5,518,220 | A | 5/1996 | Bertrand et al. | |
| D376,715 | S | 12/1996 | Few | |
| 5,613,418 | A | 3/1997 | Guido | |
| 5,638,387 | A | 6/1997 | Palleggi et al. | |
| 5,649,422 | A | 7/1997 | Baginski et al. | |
| 5,676,385 | A | 10/1997 | Schneider et al. | |
| 5,800,114 | A | 9/1998 | Secondi | |
| 5,901,980 | A | 5/1999 | Few et al. | |
| 5,911,408 | A | 6/1999 | Berands et al. | |
| 5,975,496 | A | 11/1999 | Hong et al. | |
| 5,975,497 | A | 11/1999 | Few et al. | |
| 6,050,573 | A | 4/2000 | Kunz | |
| D431,707 | S | 10/2000 | Few | |
| 6,135,422 | A | 10/2000 | Thomas | |
| 6,182,798 | B1 * | 2/2001 | Brady et al. | 187/282 |
| 6,189,432 | B1 | 2/2001 | Colarelli et al. | |
| 6,237,953 | B1 | 5/2001 | Farmer | |
| 6,254,054 | B1 | 7/2001 | Few | |
| 6,315,079 | B1 | 11/2001 | Berends et al. | |
| 6,634,461 | B1 | 10/2003 | Baker | |
| 6,763,916 | B2 | 7/2004 | Green et al. | |
| 6,968,963 | B1 * | 11/2005 | Zakula et al. | 212/270 |
| 2002/0100901 | A1 | 8/2002 | Topelberg et al. | |
| 2005/0098387 | A1 * | 5/2005 | Penn et al. | 187/262 |
| 2006/0102432 | A1 * | 5/2006 | Matsumoto | 187/203 |
| 2006/0285959 | A1 * | 12/2006 | Warhurst | 414/540 |

FOREIGN PATENT DOCUMENTS

| | | |
|---|---|---|
| DE | 4242705 | 6/1994 |
| DE | 4312771 | 11/1994 |
| DE | 4330099 | 3/1995 |
| DE | 29615428 | 1/1997 |
| DE | 29700687 | 3/1997 |
| DE | 19600791 | 7/1997 |
| DE | 4401314 | 8/1998 |
| DE | 19731345 | 1/1999 |
| DE | 299 16 254 U1 | 4/2000 |
| DE | 4409550 | 8/2000 |
| EP | 0296151 | 7/1987 |
| EP | 0263262 A2 | 4/1988 |
| EP | 0263262 B1 | 4/1988 |
| EP | 0568938 | 4/1993 |
| EP | 0669281 | 7/1997 |
| EP | 0893391 | 6/1998 |
| EP | 0860395 | 8/1998 |
| FR | 2717456 | 3/1994 |
| WO | WO 92/19527 | 11/1992 |
| WO | WO 98/30488 | 7/1998 |
| WO | WO 98/31183 | 7/1998 |

OTHER PUBLICATIONS

Under Hoist Jack for Automotive and HD Truck Use, published by Norco Professional Lifting Equipment, dated Jan. 2000.

New Developments In Electrical Actuators for Post Brakes and Electrical Devices for Material-Handling Equipment, by N.I. Ivashkov, published in Russian Journal of Heavy Machinery, No. 12, pp. 6-10, dated 1995.

Microprocessor- Based Control Device for Lifts and Other Transport Systems Plants, published in EDPE '94, Pula, Croatia, pp. 261-264, dated Sep. 12-14, 1994.

Electric Steering Drives Replace Hydraulic Units, by Phil Kingsley, published in Power Transmission Design, pp. 57-59, dated Aug. 1994.

Design of a Battery Powered Skid-Steer Loader, by K. Chicoine, et al., published in SAE Technical Paper Series 851516, pp. 1-6, dated Sep. 9-12, 1985.

Motor- Pumps (Innovations), by R.T. Schneider, published in Hydraulics & Pneumatics, vol. 55, No. 1, dated Jan. 1, 2002.

Lift Tables (Southworth Products Corp.) (Brief Article), published in American Printer, vol. 225, No. 1, dated Apr. 1, 2000.

Walk- Behind Floor Crane. (Brief Article), published in IIE Solutions, vol. 32, No. 8, dated Aug. 1, 2000.

* cited by examiner

COORDINATED LIFT SYSTEM WITH USER SELECTABLE RF CHANNELS

CROSS-REFERENCE TO RELATED APPLICATION

This application claims priority under 35 U.S.C. 119(e) and 37 C.F.R. 1.78(a)(4) based upon copending U.S. Provisional Application Ser. No. 60/491,953 for COORDINATED LIFT SYSTEM WITH SELECTABLE RF CHANNELS, filed Aug. 1, 2003.

BACKGROUND OF THE INVENTION

The present invention relates to a coordinated lift system and, more particularly, to a coordinated lift system incorporating at least two lift mechanisms that communicate by wireless signals on user selected RF channels to coordinate lift mechanisms in the raising and lowering of a vehicle.

The need to lift a vehicle from the ground for service work is well established. For instance, it is often necessary to lift a vehicle for tire rotation or replacement, steering alignment, oil changes, brake inspections, exhaust work, and other automotive maintenance. Traditionally, lifting a vehicle has been accomplished through the use of equipment that is built-in to the service facility, such as either lift units with the hydraulic actuator(s) installed below the surface of the floor or two and four post type lift systems installed on the floor surface. These built-in units are located at a fixed location at the service facility and adapted to engage the vehicle frame to lift the vehicle from the ground. However, built-in units tend to be relatively expensive and are sometimes not as useful as they might otherwise be due to their immobility.

In an effort to increase the versatility and mobility of lift devices and reduce the need to invest in permanently mounted lifting equipment, devices commonly known as a mobile column lifts (MCL's) have been developed. Apparatus for lifting a vehicle using multiple MCL's is described in U.S. Pat. No. 6,315,079 to Berends et al. The lifting device in the Berends patent includes using a number connecting lines or wires to provide electrical power and control of the MCL's. The lines or wires that are connected between the MCL's allow the vehicle to be raised or lowered in a coordinated fashion. However, the lines and wires used to connect the MCL's extend across and are looped within the working area. The presence of the wires and lines in the work area poses a hazard to people working near the vehicle, and the connecting lines may be damaged by vehicles driving over them.

Another apparatus for lifting a vehicle using multiple MCL's is described in U.S. Pat. No. 6,634,461. The '461 lifting device includes multiple MCL's that are coordinated by coded wireless signals, such as RF (radio frequency) signals, and powered by rechargeable batteries in each lift unit. By these means, the lifting devices in the '461 patent eliminate the need for both power cables and control cables. However, the wireless system of '461 does not allow the user to select the frequency of operation of transceivers of the control units of the lift devices. For this reason, two systems may not be usable simultaneously in a given location without the possibility of interference. Further, if signal interference occurs at a specific location, the frequency on which the system is operating cannot be changed in the field to avoid such interference.

Accordingly, there remains a need for a control unit for a wireless mobile lift system with intercommunication frequencies which can be user selected in the field to avoid interference from other lift systems or from unknown sources.

SUMMARY OF THE INVENTION

The present invention provides a lift system that coordinates the raising and lowering of a vehicle or other structure relative to a surface using sets of mobile column lift units, each having self-contained battery power, and wirelessly coordinated through the use of RF signals which are communicated on RF channels conveniently selectable in the field by the user.

In general, the lift system includes at least two lift mechanisms, each including a support frame, a post or vertical guide member, a carriage slidably mounted on the post, an actuating device engaged between the support frame and the carriage, and a controller or control device. The carriage is adapted to engage and support a portion of the vehicle, such as a vehicle tire. The actuating device, such as a hydraulic cylinder with a hydraulic pump and suitable valves, is selectively activated to move the carriage relative to the post. The control device is interfaced with the actuating device and includes wireless transceiver circuitry, such as an RF transceiver including circuitry to operate one any of a plurality of RF channels. The control devices on the lifting mechanisms communicate with one another by wireless RF signals to coordinate the movement of each carriage along the posts to raise or lower the vehicle relative to the surface. The purpose of such coordination is to maintain the vehicle, or other structure, in a substantially level plane during lifting and lowering. The control device further includes channel selector switching whereby any one of the available radio frequency channels may be conveniently selected by the user in the field.

Additionally, the control device include a height sensor, a digital display, and a stop mechanism. The height sensor is engaged between the support frame and the carriage and is used to determining the position of the carriage relative to the post. The stop mechanism operates to prevent movement of the carriage relative to the post of any lift mechanism of a coordinated set. Each lift unit includes a rechargeable battery, such as a marine type lead-acid battery, that provides portable power to the control device and the actuating device to move the loaded carriage relative to the post. The present invention may include a separate remote control device capable of communicating with the control device using wireless signals to raise or lower the vehicle relative to the surface without being stationed to a particular location.

The present invention provides method for the coordinated lifting and lowering of a vehicle relative to a surface. The method generally includes providing first and second lift mechanisms, placing the first and second lift mechanisms in contact with a portion of the vehicle, such as a vehicle wheel, selecting a particular RF channel on each control device, sending a wireless control signal from the first lift mechanism, receiving the wireless signal at the second lift mechanism wherein wireless signal instructs the second lift mechanism to move the vehicle relative to the surface, and moving the vehicle using the first lift mechanism in coordination with the second lift mechanism. The method also includes steps such as the entry of the number of lift mechanisms to be used in the lifting operation and the wireless querying of the lift mechanisms to determine the actual number of lift mechanisms present, prior to enabling coordinated operation of the lift mechanisms.

Each of the lift mechanisms preferably includes surface engaging wheels and a tongue or handle which enable the lift mechanisms to be moved manually to the required location. Each lift mechanism may also include carriage adapters to expand the range of vehicle wheels which the carriage may usefully engage. Alternatively, other carriage adapters may be provided for lifting structures other than vehicles, such as aircraft, shipping containers, housing construction subassemblies, and the like.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
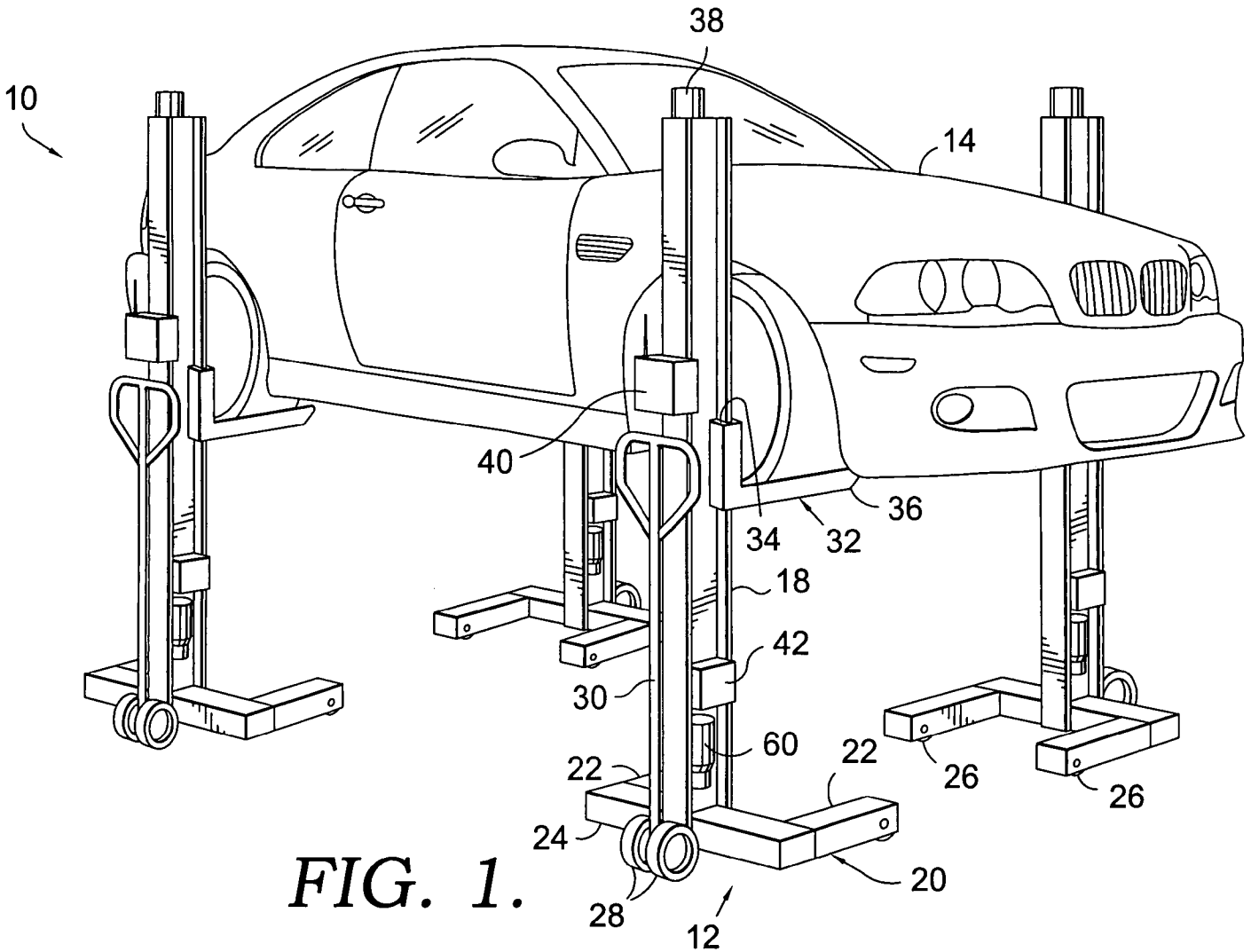
FIG. 1 is a perspective view illustrating a plurality of lift mechanisms according to the present invention, shown supporting a vehicle in a raised position.

Referring now to the drawings in detail, and initially to FIG. 1, numeral 10 generally designates a coordinated lift system with user selectable RF channels which embodies the present invention. Generally, the lift system 10 includes four lift mechanisms, or mobile column lifts (MCL's), 12 that communicate by wireless signals to coordinate the movement of a vehicle 14 relative to a surface, such as pavement, a garage floor, or the like. It should be understood and appreciated that the number of lift mechanisms 12 used in the present invention may vary depending on the type of vehicle being lifted. Typically, the lift mechanisms 12 are used in pairs. For example, six lift mechanisms may be used to lift a three axle vehicle for service. Furthermore, it should be understood that lift system 10 is not limited for use with vehicles, but also may be used to raise or lower other objects relative to the surface, such as aircraft, industrial machinery, shipping containers, construction subassemblies, and the like.

Each lift mechanism 12 includes a support frame formed by a post or guide 18 upstanding from a base 20. The base 20 includes a pair of flanges legs that are joined to one another by a cross piece 24. A pair of front wheels 26 are rotatably mounted at an end of the legs 22. A pair of main or rear wheels 28 are rotatably mounted adjacent to cross piece 24. The wheels 26, 28 enable the lift mechanism 12 to be rolled along the surface and placed in a position to support vehicle 14. A handle 30 is linked to the wheels 26, 28 and may be moved about a pivot point established adjacent to wheels 28. The handle 30 may be used to place wheels 28 in contact with the surface so that lift mechanism 12 may be rolled into position. Once the lift mechanism 12 is in a desired position, the handle 30 is then used to raise wheels 28 so that they are no longer in contact with the surface. The illustrated wheels 26 are preferably mounted on spring loaded mechanisms (not shown) which are overcome by the weight of the vehicle 14 so that the legs 22 securely contact the floor surface during lifting. The lift mechanism 12 is thereby placed in a stable position for raising and lowering the vehicle 14.

The post 18 is mounted to cross piece 24 and extends upwardly therefrom. The lifting mechanism 12 includes a carriage 32 that is slidably mounted on the post 18. Specifically, carriage 32 includes a pair of spaced apart, upright slot portions 34 that engage a flanges of the post 18 to guide the carriage 32 in movement along the post 18. The carriage 32 includes a pair of forks 36 that extend outwardly from slot portions 34 and are adapted to support a portion of vehicle 14. In particular, the illustrated forks 36 are adapted to support the vehicle 14 at a wheel. However, it should be understood that carriage 32 may also be adapted to engage and support the frame or any other portion of vehicle 14 or other type of structure with the system 10 is intended to lift.

The carriage 32 may be moved relative to the post 18 using a linear actuator, such as a hydraulic piston and cylinder assembly 38. The cylinder 38 is engaged between the support frame, by way of the post 18 or base 20, and the carriage 32 in such a way that extension and retraction of the cylinder 38 moves the carriage 32 upwardly or downwardly along the post 18. A power unit or motorized hydraulic pump 39, in combination with suitable valves (not shown), is used to move a fluid into the cylinder in such a manner to cause the cylinder 38 to extend, as will be described in further detail below. Extension of the cylinder 38 causes carriage 32 move upwardly relative to the surface. As fluid is removed from the cylinder 38, the cylinder moves downwardly and carriage 32 is lowered by gravity. It should be understood that hydraulic piston and cylinder assembly 38 could alternatively be replaced by a pneumatic actuator, a motorized jackscrew, or an equivalent kind of actuator. Further, it is considered within the scope of the present invention to use a double acting cylinder to move the carriage 32 relative to the post 18.

Each lift mechanism 12 includes a control box 40 or control unit configured to control activation of the local lift cylinder 38 and to communicate with the other control boxes 40 in lift system 10 by wireless signals to coordinate the raising and/or lifting of vehicle 14. The control unit 40 includes a controller or control processor 35 (FIG. 7), such as a microprocessor which is programmed to perform its desired control and communication functions. A wireless transceiver, such as a radio frequency (RF) transceiver 37, is also mounted in the control box 40 and includes an externally mounted antenna 44 to radiate RF signals to transceivers 37 in other control boxes 40 and to receive signals therefrom. A rechargeable battery 42 provides electrical power to components within the control box 40 through a power switch 43 and also provides operating power for the hydraulic pump 39 to activate the lift cylinder 38, so that each lift mechanism 12 can operate without power cables or control cables. The transceiver 37 includes circuitry which provides for operation on one of a plurality of RF channels which can be selected by the user in the field, as will be described in more detail below.

Figure 2:
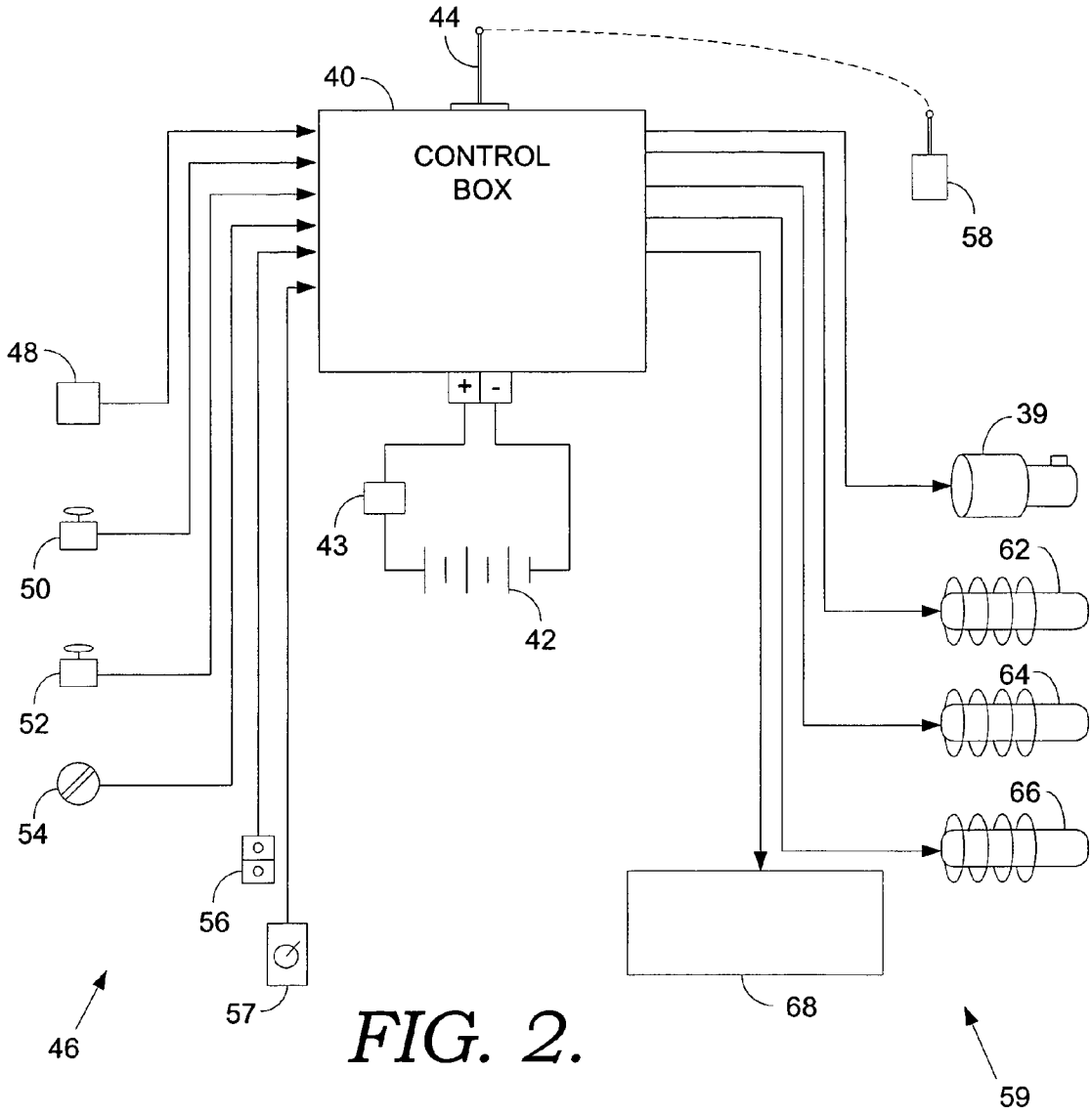
FIG. 2 is a schematic diagram showing input and output components associated with the control devices of each of the lift mechanisms of the present invention.
Figure 6:
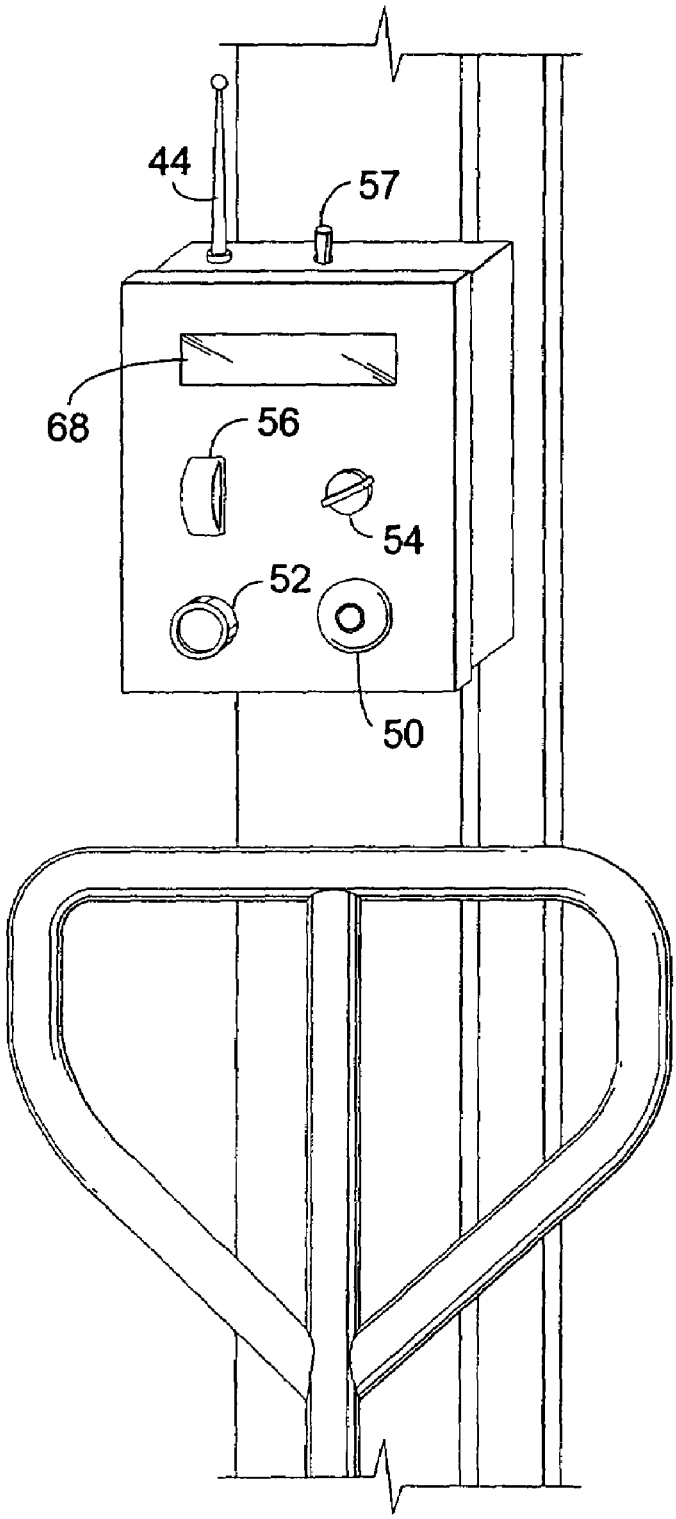
FIG. 6 is an enlarged perspective view of a control device of a lift mechanism.

The control box 40, shown in FIGS. 2 and 6, is interfaced to a number of components, designated as input components 46. One input component is a height sensing detector or sensor 48 which determines the height of the carriage 32 relative to the surface and relays such information to control box 40. The illustrated height sensor 48 is preferably a relative position sensor, such as one which employs an optical detector of spaced openings, markings, or the like. Such an optical detector (not shown) could be used with either a rotary or a linear set of markings. Alternatively, an absolute type of position encoder could be employed, the particulars of which would be familiar to one skilled in the art. Other input components include an emergency stop switch 50, an interlock function switch 52, a mode selector switch 54, an up/down motion switch 56, and a communication channel selector switch 57. The emergency stop button 50 enables a user to instruct the control box 40 to stop moving carriage 32 relative to post 18. For safety, the interlock function switch 52 is required to be engaged before lifting or lowering of the carriage 32 can occur. When the lift system 10 is in a synchronized mode for coordinated lifting, the interlock function 52 also allows a user to specify which one of the control boxes 40 will be a master control box. Once a master control box is selected, the remaining control boxes 40 are designated as slave control boxes and operate under user control actions initiated at the master control box. A more detailed discussion of the coordinated operation of the lift mechanism 12 will be provided below.

The mode selector switch 54 allows the control box 40 to be toggled between an off mode and a synchronized mode. The motion switch 56 selects the direction of movement and causes the control box 40 to initiate raising or lowering of the carriage 32 relative to the surface. The emergency stop, interlock or motion input components 46 described above may alternatively be activated by a remote control device 58 by use of a wireless link. The channel selector switch 57 enables the user to select which RF channel the system 10 will use to communicate among the individual lift units 12. It should be appreciated that it is within the scope of the present invention to provide for other input devices such as, but not limited to, a level sensor (not shown) adapted to determine the orientation of a post 18 relative to vertical.

The control box 40 is interfaced to a number of components which may be referred to as output components 59. The illustrated output components 59 may include the hydraulic pump 39, a lowering valve solenoid 62, a holding valve solenoid 64, and a safety release solenoid 66. The output components 59 are are used to control the movement of carriage 32 relative to post 18. In particular, the hydraulic pump 39 moves fluid within the cylinder to raise carriage 32, as further controlled by valves (not shown) associated with the solenoids 62, 64, and 66. The lowering valve solenoid 62 is activated to release fluid from the cylinder to thereby lower carriage 32 toward the surface under the influence of gravity. The holding valve solenoid 64 normally maintains the position of carriage 32 relative to post 18. The safety release solenoid 66 is a backup mechanism that normally functions upon the failure of cylinder assembly 38 to prevent carriage 32 from inadvertently falling downwardly toward the ground. During the normal lowering operation of the lift system 10, both the holding valve solenoid 64 and the safety release solenoid 66 may be activated to release the carriage 32 and allow it to move relative to post 18. The control box 40 includes display 68 which displays information such as, but not limited to, the height of one or more of the lift mechanisms 12, the selected RF channel on which the control boxes 40 are communicating, the state of charge of the battery 42, status codes, error codes, and any other information essential to operation of the system 10.

In operation, one or more lift mechanisms 12 are first placed in a position to support a portion of the vehicle 14. In particular, the forks 36 are placed on opposite sides of a vehicle tire in a support position. As previously stated, in order to provide a mobile and convenient lift system 10, each of the lift mechanisms 12 is powered by rechargeable battery 42. Energy stored in the battery 42 provides the power required for the operation of the lift mechanism 12 and the control box 40. The battery 42 may be recharged when the lift mechanism 12 is not in actual operation, that is, not actually lifting or lowering a vehicle.

Figure 3:
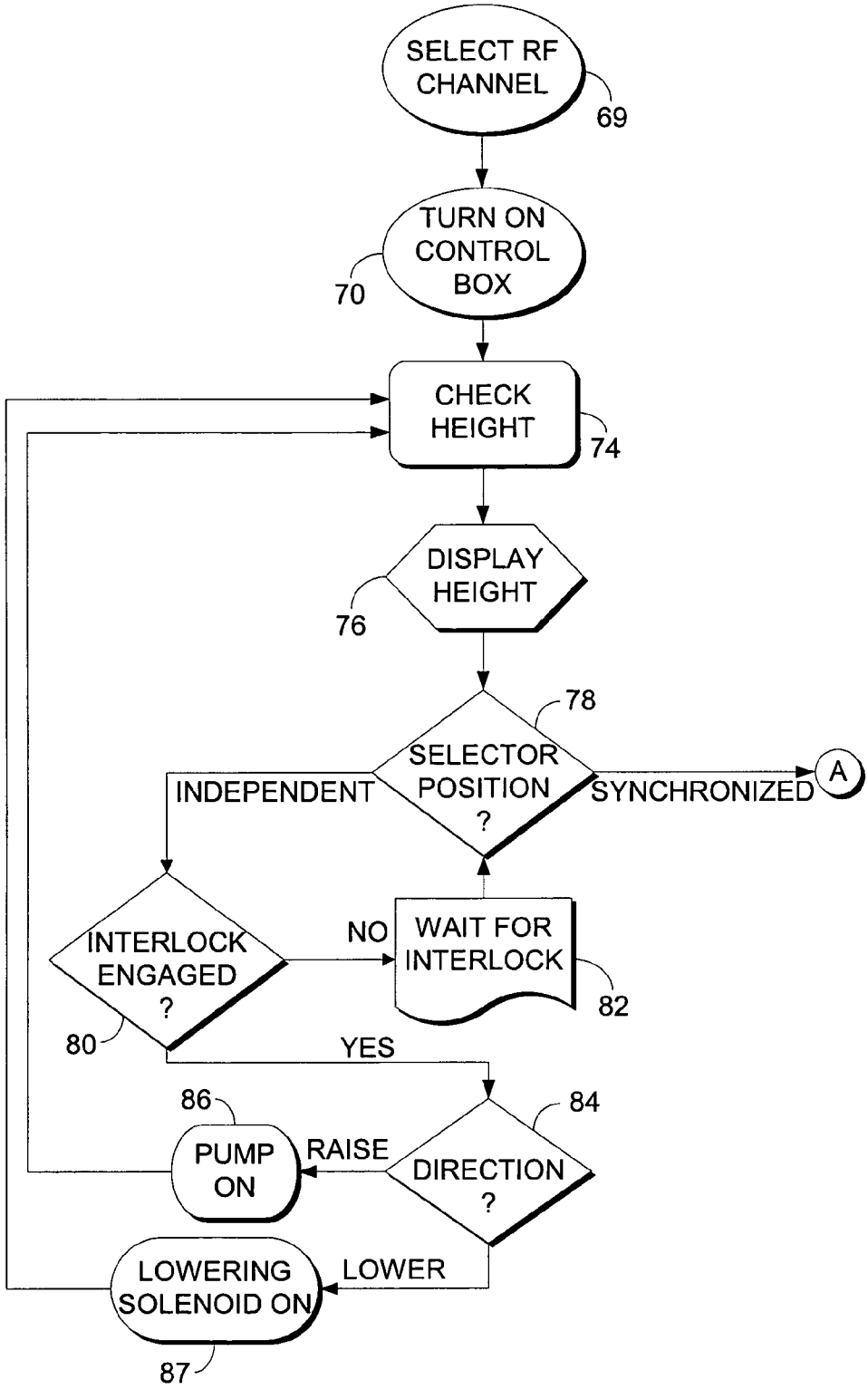
FIG. 3 is a flow chart illustrating a portion of the operation of the control device of the present invention.
Figure 4:
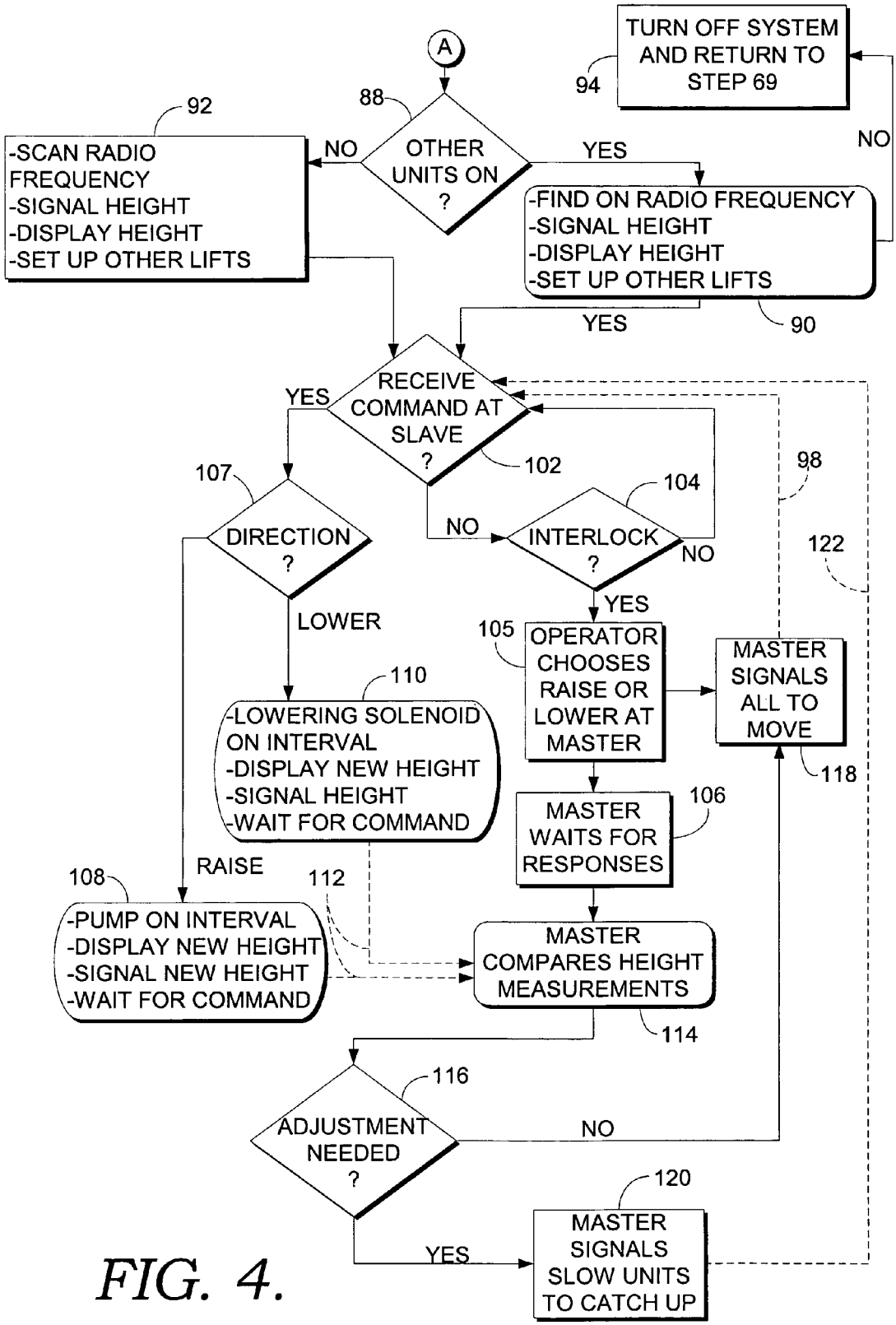
FIG. 4 is a continuation of flowchart in FIG. 3 illustrating a portion of the operation of the control device, the wireless communications being shown in broken lines.

The synchronized mode of operation allows input commands at one control box 40 to influence other control boxes within the system 10 to provide a coordinated lift of vehicle 14. Coordination of the lifting operation is required to maintain the lifted vehicle 14 in a substantially level orientation, that is, to avoid tipping the vehicle or other load. Initially, referring to FIG. 3, each control box 40 is set to a selected RF channel at step 69, using the channel selector switch 57. The control box 40 on one of the lift mechanisms 12 is turned on at step 70 and proceeds to perform steps 74 and 76 where the height is checked and displayed. At step 78, the mode selector switch 54 is set to the synchronized mode position, if it is not already in such a position. Referring to FIGS. 3 and 4, at step 88 a determination is made as to which of control boxes 40 will take part in the coordinated lift of vehicle 14. Preferably, the number of lift mechanisms 12 to be used is entered into the master control box. At this point all participating control boxes 40 should be set to the same channel. Next, any other lift mechanisms 12 that will take part in the lift should be set up. Set-up includes setting the control box 40 to the same channel, step 69, and turning the unit on, step 70. If no other control boxes 40 are turned on, then lift mechanism 12 proceeds to step 90 where it scans for the selected radio frequency channel and signals the height. In addition, the control box 40 may displays its height as the operator sets up the other participating lift mechanisms in step 90. Once a control box 40 is placed in synchronized mode, it searches to communicate with one or more lift mechanisms 12 at the selected frequency.

Once the other control boxes have been turned on, the lift system 10 moves to step 92 at which each of the control boxes 40 are communicating at the same selected radio frequency. Each of the height sensors 48 provides a height measurement to its respective control box 40, and the control boxes 40 provide the height measurement on the display. In step 92, the control boxes 40 search for other control boxes 40 on the selected channel. If interference occurs or there is an unclear data exchange between the lift mechanisms 12, an error message or signal loss is shown on the display 68 and the user is prompted to reset the system and select another channel. If this action occurs, the user must turn off the control boxes 40 at step 93 and start the process from the beginning at step 69 by selecting a different RF channel. This process may be repeated until a clear channel is located.

Figure 5:
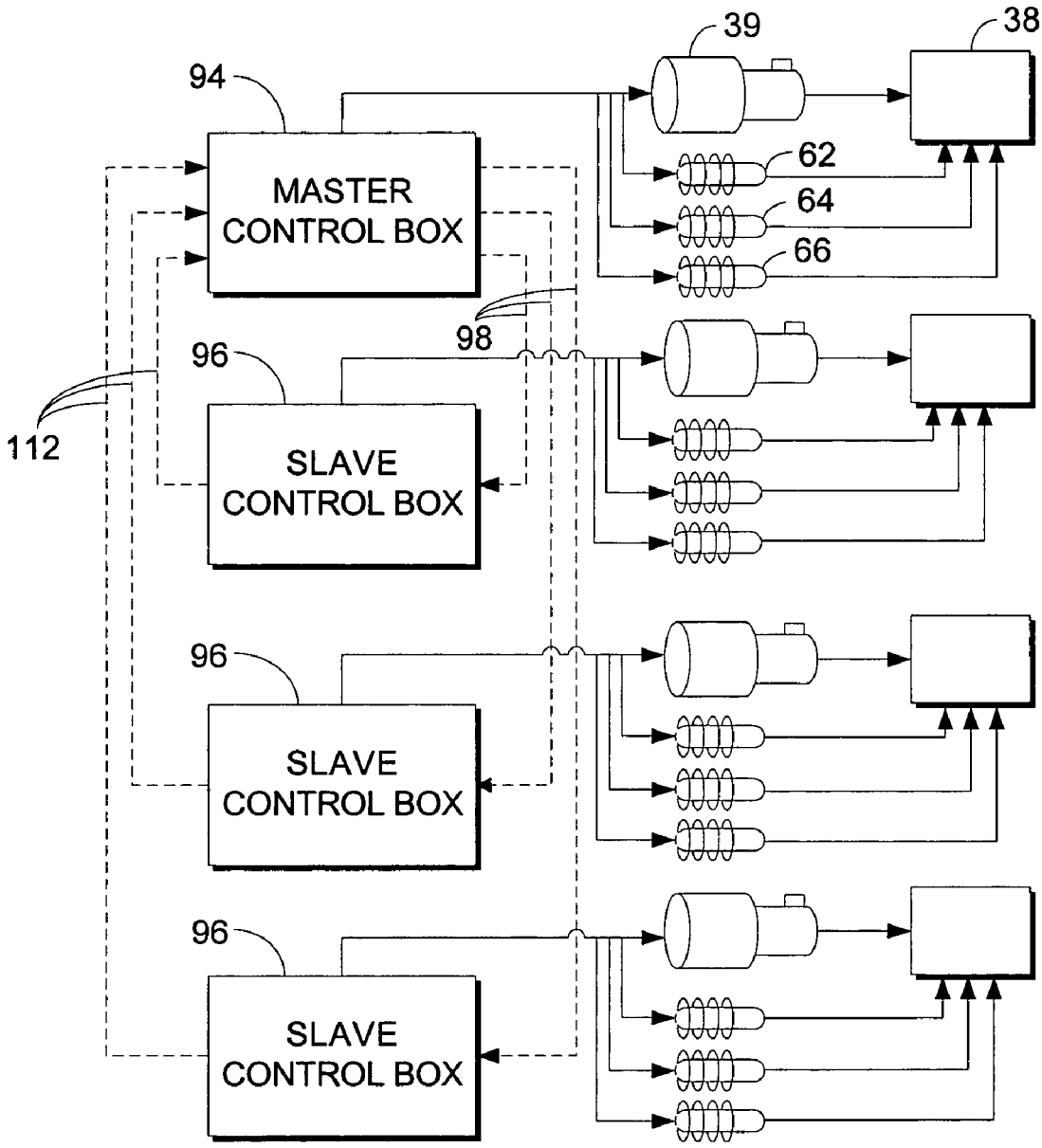
FIG. 5 is a schematic diagram illustrating communications between a master control device, slave control devices, and associated output device, the wireless communications being shown in broken lines.

However, if no interference occurs, the lift system moves from step 90 to step 102, or from step 92 to step 102. In step 102, each of the control boxes 40 waits for a command from its own box, remote control 58, or one of the other control boxes by wireless communication. The first control box 40 which is activated is designated as the master control box 94, and the remaining control boxes 40 are designated as slave control boxes 96, as shown in FIG. 5. If none of the control boxes 40 receive a command, then the process proceeds to step 104 where master control box 94 may be established by selecting the interlock function 52 on any one of the control boxes 40. If the interlock function is not selected, then the process returns to step 102 where each of the lift mechanisms 12 waits for a command. If the interlock is selected, then the operator chooses to raise or lower the vehicle at the master control box 94 as shown in step 105. With additional reference to FIG. 5, the master control box 94 proceeds to command the slave control boxes 96 to raise or lower by one or more wireless signals 98 at step 118 by operation of the up/down motion switch 56, and waits for a response from each of the slave control boxes 96 at step 106. Once the wireless signals are sent via the selected channel by the master control box 94 at step 118, the slave control boxes 96 wait to receive a command at step 102. If one or more of the slave boxes 96 do not receive the wireless signal from the master control box 94, the process remains at step 102.

However, if the slave control boxes 96 receive wireless signal 98 from the master control box 94, then the slave control boxes 96 must determine whether to raise, lower or hold the vehicle at step 107. As best seen in FIGS. 4 and 5, if the wireless signal 98 provides an instruction to raise vehicle 14, the master control box 94 and each of the slave control boxes 96 activate their respective pump 39 to cause the cylinder assembly 38 to move the vehicle in an upward direction. If the wireless signal 98 provides an instruction to lower the vehicle 14, the master control box 94 and each of the slave control boxes 96 activates their lowering valve solenoid 62, holding valve solenoid 64, and safety release solenoid 66 to cause the cylinder assembly 38 to move the vehicle downwardly, as shown at step 110. The pump 39 and the lowering valve solenoid 62 are preferably activated in intervals when the lift mechanisms 12 are raising and lowering the vehicle from the surface respectively. However, it should be understood and appreciated that the intervals may be of such a short duration that the lift mechanisms 12 operate to smoothly raise or lower the vehicle relative to the surface. The operation of the pump and lowering valve solenoid 62 may alternatively be conducted in a substantially continuous manner without any apparent intervals.

Notwithstanding whether the vehicle 14 is being raised or lowered as described in steps 108 and 110, the height sensors 48 on each lift mechanism 12 determine the new height of the carriage relative to the surface, convey that information to their respective control boxes 94, 96, provide the height on displays 68 and wait for another command as illustrated in FIGS. 4 and 5. The slave control boxes 96 then send the height information by wireless signals 112 to the master control box 94. At step 114, the master control box 94 compares its own height measurement with the height measurements sent by the slave control boxes 96 during the lifting or lowering of the vehicle 14 and determines if an adjustment is needed at step 116. If the heights of each of the slave control boxes 96 are within a predetermined tolerance range, the master control box 94 sends a signal to all of the lift mechanisms continue to lift or lower the vehicle at step 118. Once the vehicle 14 has reaches a desired height, the lift system 10 may then proceed from step 118 and return to step 102 where the slave control boxes 96 wait for a further command. Alternatively, if the master control box 94 receives a signal 112 that indicates that one or more of the other lift mechanisms 12 are not at the proper height and an adjustment is need, the master control box 94 will determine the rate of speed at which the lift mechanisms 12 must operate in order to maintain synchronism or coordination in the lift of the vehicle 14, instructs the slow mechanisms to catch up in step 120 by one or more wireless signals 122, and returns to step 102.

It should be appreciated from the above descriptions that two separate lift systems 10 may be used in close proximity. Initially, in step 69, the two separate lift systems 10 must be set to different RF channels. However, once the separate systems 10 are placed on different channels, the remaining steps are the same as described above.

The above described process for coordinating the lift of a structure using a plurality of actuators, such as hydraulic cylinders, provides an exemplary method of coordinating or synchronizing the cylinders, using wireless links between the lift mechanisms 12. Other methods for coordinating multiple lifting actuators using controllers interconnected by cables are known within the art, and information concerning one such method can be obtained by reference to U.S. Pat. No. 4,777,798, which is incorporated herein by reference.

Figure 7:
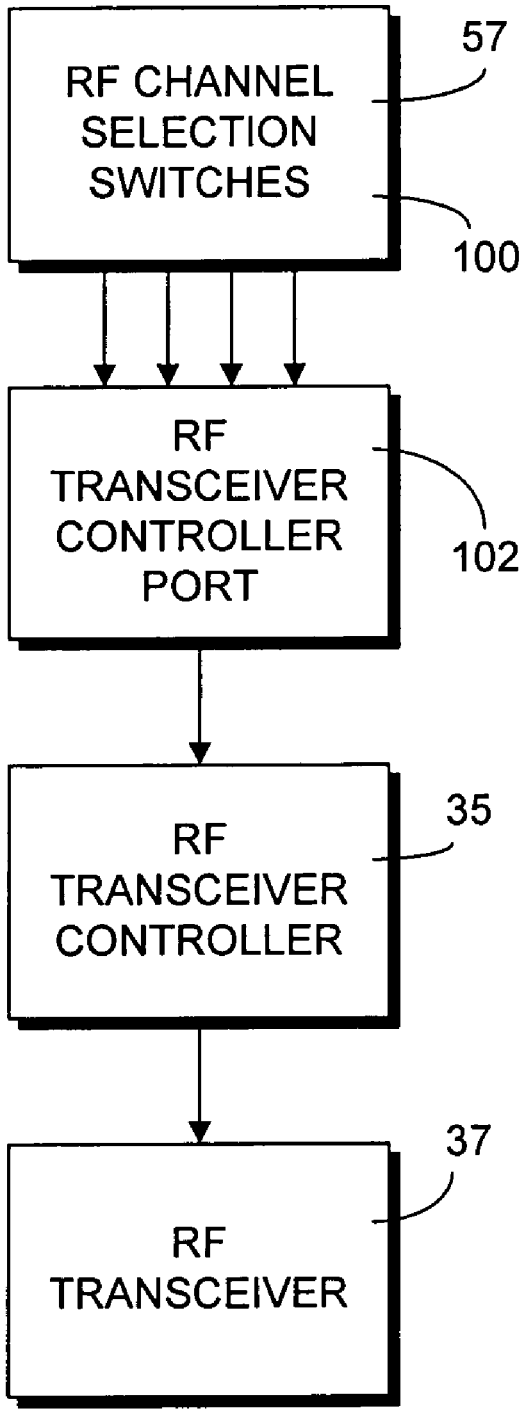
FIG. 7 is a block diagram illustrating an embodiment of RF channel selection switches for the lift mechanisms of the present invention.

The channel selection switching 57 may be a multiposition rotary switch as shown in FIG. 6. FIG. 7 shows an alternative to a rotary switch. In FIG. 7, four two-state switches 100, such as on/off switches, are interfaced to a port 102 of the controller 35. The two states of four such switches provides for sixteen switch state combinations. Each switch combination represents a binary number which is associated with a particular RF channel. The controller 35 reads the state of the switches 100 and sets the channel of the transceiver 37 according to the binary number read. The switches 100 may, for example, be toggle switches which are mounted on an externally accessible panel of the control box 40.

In order to provide for a safe working environment for a user, the lift system 10 includes safety features to prevent inadvertent movement of the vehicle 14. Specifically, the lift system 10 may provide for security features to prevent extraneous signals from interfering with the communications between the control boxes 40. For example, each control box 40 may have a unique identifier associated therewith, wherein each communication sent by that control box 40 includes its unique identifier. The unique identifier may be in the form of a serial number. The receiving control boxes 40 may react to a communication from another control box 40 only if it the included serial number is recognized. This type of security feature prevents outside interference causing undesired activation of the lift mechanism 12. In addition, the lift system 10 may also utilize other types of safety features, such as special encoding or encryption of the signals, or the like. Specifically, as shown in FIGS. 2 and 5, the safety release solenoid 66 may activate an independent mechanical latch (not shown) during the lowering function to prevent a carriage 32 on a lift mechanism 12 from falling to the surface upon a failure the cylinder assembly 38. Furthermore, the emergency stop button 50 may also be activated at any point from any lift mechanism during the raising or lowering of vehicle 14 to stop further movement of carriage 32 relative to post 18.

The present invention provides a lift system 10 that includes a plurality of lifting mechanisms 12 that communicate with each other using wireless signals to raise or lower a vehicle in a coordinated fashion. The channel selection capability allows the user to easily reset the system 10 to a different channel if local interference occurs or the channel initially selected. Further, the use of selectable RF channels allows multiple systems to be conveniently used simultaneously in close proximity. Additionally, the channel selection capability provides for increased mobility and allows the lifting mechanisms 12 to be moved to different locations without the concern for interfering signals.

It is to be understood that while certain forms of the present invention have been illustrated and described herein, it is not to be limited to the specific forms or arrangement of parts described and shown.

What is claimed and desired to secure by Letters Patent is:

1. A wireless lift system for coordinated lifting of a structure and comprising:

(a) a first lift mechanism and a second lift mechanism;

(b) each of said first and second lift mechanisms including a support frame including a vertical guide member, a carriage slidingly engaged with said guide member and adapted to supportively engage a structure to lift and/or lower the structure, an actuator engaged between said support frame and said carriage, and a controller coupled to said actuator and programmed to enable selective activation of said actuator to thereby lift and/or lower said structure;

(c) each lift mechanism including a radio-frequency (RF) transceiver coupled to the controller associated therewith to enable wireless communication between controllers of said lift mechanisms;

(d) the controller of each lift mechanism being programmed to enable cooperation of said lift mechanisms by way of the RF transceivers thereof to enable coordinated lifting and/or lowering of said structure;

(e) each RF transceiver including circuitry to enable operation on any of a plurality or RF channels; and (f) each RF transceiver having a channel selector switch coupled thereto and operable to enable field selection of one of said RF channels.

2. A system as set forth in claim 1 wherein each lift mechanism includes:

(a) a rechargeable battery coupled to said actuator by way of said controller to thereby selectively provide operating power thereto.

3. A system as set forth in claim 1 wherein each lift mechanism includes:

(a) said actuator including a hydraulic cylinder and a hydraulic pump communicating hydraulic fluid to said cylinder under pressure; and (b) a rechargeable battery coupled to said hydraulic pump by way of said controller to thereby selectively provide operating power to said hydraulic pump.

4. A system as set forth in claim 1 wherein:

(a) said carriage is adapted to engage a tire of a vehicle to thereby lift said vehicle.

5. A system as set forth in claim 1 and including:

(a) an additional lift mechanism substantially similar to said first and second lift mechanisms and capable of operation in coordination therewith.

6. A system as set forth in claim 1 wherein:

(a) said controller is programmed to prevent operation of either of said lift mechanisms unless both are set to the same RF channel.

7. A system as set forth in claim 1 wherein said selector switch includes:

(a) a plurality of two-state switches coupled to said controller and capable of being set in combinations representing binary numbers;

(b) said controller being programmed to associate each possible binary number with a particular RF channel; and (c) said controller being programmed to read a binary number corresponding to a pattern in which said two-state switches are set and to select an RF channel associated said binary number.

8. A system as set forth in claim 1 wherein each lift mechanism includes:

(a) a height sensor engaged between said support frame and said carriage and communicating to said controller a height signal corresponding a location of said carriage relative to said support frame to thereby enable said coordinated lifting and/or lowering of said structure.

9. A wireless lift system for coordinated lifting of a structure and comprising:

(a) a plurality of lift mechanisms, each lift mechanism being manually movable and including a support frame including a vertical guide member and a carriage slidingly engaged with said guide member and adapted to supportively engage a structure to lift and/or lower the structure;

(b) each lift mechanism including a hydraulic cylinder engaged between said support frame and said carriage, a hydraulic pump communicating hydraulic fluid with said hydraulic cylinder, and a rechargeable battery coupled to said hydraulic pump and selectively providing operating power therefor;

(c) each lift mechanism including a controller coupling said battery to said hydraulic pump and programmed to enable selective activation of said hydraulic pump to thereby cause lifting and/or lowering of said structure;

(d) each lift mechanism including a height sensor engaged between said support frame and said carriage and communicating to said controller a height signal corresponding a location of said carriage relative to said support frame;

(e) each lift mechanism including a radio-frequency (RF) transceiver coupled to the controller associated therewith to enable wireless communication between controllers of said lift mechanisms;

(f) the controller of each lift mechanism being programmed to enable cooperation of said lift mechanisms by way of the RF transceivers thereof to enable coordinated lifting and/or lowering of said structure;

(g) each RF transceiver including circuitry to enable operation on any of a plurality or RF channels; and (h) each RF transceiver having a channel selector switch coupled thereto and operable to enable field selection of one of said RF channels.

10. A system as set forth in claim 9 wherein:

(a) said carriage is adapted to engage a tire of a vehicle to thereby lift said vehicle.

11. A system as set forth in claim 9 wherein:

(a) said controller is programmed to prevent operation of any of said lift mechanisms unless all transceivers thereof are set to a same RF channel.

12. A system as set forth in claim 9 wherein said selector switch includes:

(a) a plurality of two-state switches coupled to said controller and capable of being set in combinations representing binary numbers;

(b) said controller being programmed to associate each possible binary number with a particular RF channel; and (c) said controller being programmed to read a binary number corresponding to a pattern in which said two-state switches are set and to select an RF channel associated said binary number.

13. A wireless lift system for coordinated lifting of a vehicle and comprising:

(a) a plurality of lift mechanisms, each lift mechanism including a support frame including a vertical guide member and a carriage slidingly engaged with said guide member and adapted to supportively engage a tire of a vehicle to lift and/or lower the vehicle;

(b) each lift mechanism including a hydraulic cylinder engaged between said support frame and said carriage, a hydraulic pump communicating hydraulic fluid with said hydraulic cylinder, and a rechargeable battery coupled to said hydraulic pump and selectively providing operating power therefor;

(c) each lift mechanism including a controller coupling said battery to said hydraulic pump and programmed to enable selective activation of said hydraulic pump to thereby cause lifting and/or lowering of said structure;

(d) each lift mechanism including a height sensor engaged between said support frame and said carriage and communicating to said controller a height signal corresponding a location of said carriage relative to said support frame;

(e) each lift mechanism including a radio-frequency (RF) transceiver coupled to the controller associated therewith to enable wireless communication between controllers of said lift mechanisms;

(f) the controller of each lift mechanism being programmed to enable cooperation of said lift mechanisms by way of the RF transceivers thereof to enable coordinated lifting and/or lowering of said vehicle;

(g) each RF transceiver including circuitry to enable operation on any of a plurality or RF channels, said controller being programmed to prevent operation of any of said lift mechanisms unless all transceivers thereof are set to a same RF channel; and (h) each RF transceiver having a channel selector switch coupled thereto and operable to enable selection of one of said RF channels.

14. A system as set forth in claim 13 wherein said selector switch includes:

(a) a plurality of two-state switches coupled to said controller and capable of being set in combinations representing binary numbers;

(b) said controller being programmed to associate each possible binary number with a particular RF channel; and (c) said controller being programmed to read a binary number corresponding to a pattern in which said two-state switches are set and to select an RF channel associated said binary number.

15. A lift system as set forth in claim 13 wherein each lift mechanism includes:

(a) a plurality of wheels mounted on said support frame and a handle connected to said support frame to enable selective manual movement of said lift mechanism.

* * * * *

UNITED STATES PATENT AND TRADEMARK OFFICE

CERTIFICATE OF CORRECTION

PATENT NO. : 7,219,770 B2
APPLICATION NO. : 10/902684
DATED : May 22, 2007
INVENTOR(S) : William J. Baker It is certified that error appears in the above-identified patent and that said Letters Patent is hereby corrected as shown below:

Column 2, line 51, after “provides” insert -- a --.
Column 4, line 7, after “flanges” insert -- or --.
Column 4, line 30, after “engage” delete “a”.
Column 4, line 38, delete “with” and insert -- which --.
Column 4, line 49, after “32” insert -- to --.
Column 6, line 51, delete “displays” and insert -- display --.
Column 9, line 39, delete “or” and insert -- of --.
Column 10, line 17, after “corresponding” insert -- to --.
Column 10, line 41, after “responding” insert -- to --.
Column 10, line 52, delete “or” and insert -- of --.
Column 11, line 28, after “responding” insert -- to --.
Column 12, line 6, delete “or” and insert -- of --.

Signed and Sealed this

Seventeenth Day of July, 2007

JON W. DUDAS
*Director of the United States Patent and Trademark Office*